US007677465B1

(12) United States Patent
Bruning

(10) Patent No.: US 7,677,465 B1
(45) Date of Patent: Mar. 16, 2010

(54) RAILWAY CROSSING INSTALLATION

(76) Inventor: William E. Bruning, 13826 Pierce St., Omaha, NE (US) 68144

( * ) Notice: Subject to any disclaimer, the term of this patent is extended or adjusted under 35 U.S.C. 154(b) by 339 days.

(21) Appl. No.: 11/710,819

(22) Filed: Feb. 26, 2007

(51) Int. Cl.
*E01B 1/00* (2006.01)

(52) U.S. Cl. ..... 238/8

(58) Field of Classification Search ..... 238/2, 238/6–9

See application file for complete search history.

(56) References Cited

U.S. PATENT DOCUMENTS

| | | | |
|---|---|---|---|
| 2,835,451 | A | 5/1958 | Goulding, Jr. |
| 2,950,057 | A | 8/1960 | Speer |
| 3,341,123 | A | 9/1967 | Holthausen |
| 3,353,747 | A | 11/1967 | Speer |
| 3,469,783 | A | 9/1969 | Uralli et al. |
| 3,825,184 | A | 7/1974 | Hartl |
| 4,203,547 | A | 5/1980 | van der Harst |
| 4,236,670 | A | 12/1980 | Limmergard et al. |
| 4,336,906 | A | 6/1982 | Limmergard |
| 4,415,120 | A | 11/1983 | Thim |
| 4,449,666 | A | 5/1984 | Hales et al. |
| 4,457,468 | A | 7/1984 | Hales et al. |
| 4,461,421 | A | 7/1984 | Maass |
| 4,606,498 | A | 8/1986 | Grant et al. |
| 4,793,545 | A | 12/1988 | Raymond |
| 4,871,809 | A | 10/1989 | Szarka |
| 4,899,933 | A | 2/1990 | Martin |
| 5,181,657 | A | 1/1993 | Davis |
| 5,210,467 | A | 5/1993 | Nagashima |
| 5,282,569 | A | 2/1994 | Kiyota |
| 5,740,961 | A * | 4/1998 | Bruning ..... 238/8 |
| 6,079,630 | A | 6/2000 | Schroeder |
| 6,588,676 | B1 | 7/2003 | Birt et al. |

* cited by examiner

*Primary Examiner*—S. Joseph Morano
*Assistant Examiner*—Robert J McCarry, Jr.
(74) *Attorney, Agent, or Firm*—Dennis L. Thomte; Thomte Patent Law Office LLC

(57) ABSTRACT

A railway crossing installation for a pair of spaced-apart elongated rails each having a transverse section, a bottom horizontal flange, a vertically extending bight and a top ball. A plurality of relatively elongated concrete gauge panels are provided, with each gauge panel having a top surface generally aligned with the ball upper surface, each gauge panel having elongated sides disposed adjacent the rails and ends disposed in confronting relation to any adjacent gauge panels. The gauge panel side adjacent a rail has an integral elongated projection spaced below the panel top surface, with the projection extending towards the bight. A resilient, elongated extrusion extends along each gauge panel side between the projection side and the rail bight, the extrusion being selectively removably secured to the projection so that the outer ends of the extrusion is closely adjacent the associated rail. The installation also includes concrete field panels positioned outwardly of each of the rails. The inner sides of the field panels have a resilient seal secured thereto which extends towards the associated rail.

10 Claims, 5 Drawing Sheets

RAILWAY CROSSING INSTALLATION

BACKGROUND OF THE INVENTION

1. Field of the Invention

This invention relates to a railway crossing installation and, more particularly, to an arrangement and construction of elastomeric or rubber extrusions or seals which are positioned on the sides of gauge panels and the inner end of field panels. More particularly, the invention relates to elastomeric or rubber extrusions which are selectively removably secured to the gauge panels and the field panels.

2. Description of the Related Art

For years, railroads have built up the spaces between rails and the areas beside the rails to achieve level grade crossings. And, also over the years, a wide variety of constructions have been suggested, particularly those that conform to the lateral profile of the rails. For example, in the United States, a disclosure of the installation of elongate elastomeric pads and non-elastomeric panels is seen in U.S. Pat. No. 5,181,657. Earlier disclosures in U.S. patents include rigid material between rails and a deformable resilient cushion between the rigid material and the rails, as in U.S. Pat. No. 2,835,451. Other deformable cushioning members are disclosed in U.S. Pat. Nos. 3,469,783; 4,461,421; and 4,606,498. Other shaped resilient filler strips are seen in U.S. Pat. Nos. 2,950,057; 3,353,747; 4,449,666; 4,457,468; 4,793,545; 4,871,809; 4,899,933; and 5,201,467. A tar filler between the rails and panels of German origin is seen in U.S. Pat. No. 3,341,123. A C-shaped resilient filler strip of Austrian origin is seen in U.S. Pat. No. 3,825,181. One of Dutch origin is seen in U.S. Pat. No. 4,203,547. One of Swedish origin is seen in U.S. Pat. Nos. 4,236,670; 4,336,906; and 4,415,120. A rubber covered installation of Japanese origin is seen in U.S. Pat. No. 5,282,569.

Applicant designed and patented an improved railway crossing installation as disclosed in U.S. Pat. No. 5,740,961 issued Apr. 21, 1998. Although the railway crossing installation of the above-identified patent did solve many of the problems of the prior art, it has been found necessary to provide field panels and gauge panels wherein the rubber or elastomeric seals thereof may be quickly and easily removed and replaced as required. Further, it has been found necessary to be able to reduce the costs of fabricating the gauge and field panels. In an effort to reduce the costs of fabricating the field and gauge panels, the elimination of the need of welding is desirable due to the high labor costs associated with welding. Further, the elastomeric or rubber seals must be easy to install and easy to replace and function in a superior manner.

SUMMARY OF THE INVENTION

A railway grade crossing installation is disclosed which comprises one or more concrete gauge panels positioned between the rails and one or more concrete field panels which are positioned adjacent the outer sides of the rails. Each of the gauge panels has a top surface which is generally aligned with the upper surface of the ball of the rail with each of the gauge panels having elongated first and second sides disposed adjacent the rails. The gauge panels have ends which are disposed in confronting relationship to any adjacent panels. Each of the sides of the gauge panel has a projection extending therefrom towards the associated rail which includes a substantially vertically disposed upper wall portion, an intermediate wall portion, and a lower wall portion. Each of the sides of the gauge panel has a plurality of elongated threaded fasteners which are partially embedded in the concrete projection in a manner so as to have protruding portions which protrude outwardly from the lower wall portion of the projection in a horizontally spaced-apart manner. First and second resilient, elongated flat strips are selectively removably secured, adjacent their lower ends, to the outwardly protruding portions of the threaded fasteners at the first and second sides of the gauge panels, respectively. The lower ends of the inner faces of the first and second strips are positioned adjacent the lower wall portions of the associated projection with the upper ends of the flat strips being positioned adjacent the associated rails. First and second metal angle members are secured to the first and second sides of the gauge panel, respectively, so as to be positioned adjacent the upper wall portion and the intermediate wall portion of the associated projection.

The inner side or end of each of the field panels has an elongated resilient angle member secured thereto by means of horizontally spaced-apart fasteners which are partially embedded in the side of the field panel and which have portions thereof which protrude therefrom to which the resilient angle members are removably connected.

It is therefore a principal object of the invention to provide an improved railway crossing installation.

A further object of the invention is to provide an improved railway crossing installation which may be fabricated in an economical manner.

Still another object of the invention is to provide a railway crossing installation which is superior to prior art designs.

Yet another object of the invention is to provide a railway crossing installation which is easy to install and easy to replace.

Yet another object of the invention is to provide a railway crossing installation which results in monetary savings due to the elimination of some welding procedures.

Still another object of the invention is to provide a railway crossing installation wherein the elastomeric or rubber seals on the field panels and the gauge panels are quickly and easily removed and/or replaced.

These and other objects will be apparent to those skilled in the art.

DESCRIPTION OF THE PREFERRED EMBODIMENT

Figure 1:
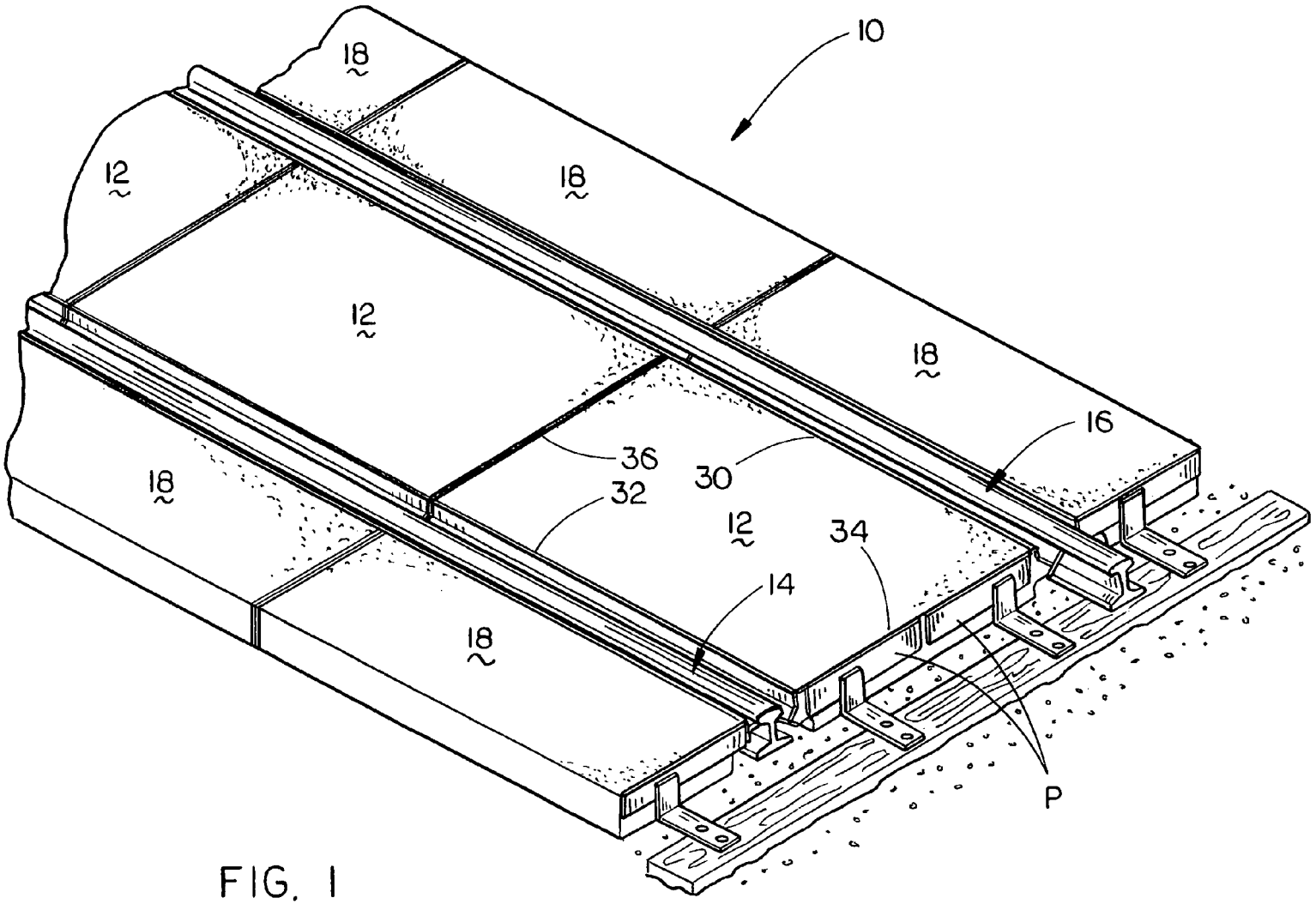
FIG. 1 is a partial perspective view of the railway crossing installation of this invention.

The numeral 10 refers to the railroad crossing installation of this invention including one or more gauge panels 12 positioned between a pair of rails 14 and 16 and one or more field panels 18 positioned outwardly of the rails 14 and 16. Each of the rails 14 and 16 are identical with only rail 16 being described in detail. Rail 16 includes a bottom horizontal flange 20, a vertically extending web or "bight" 22 and a top ball 24 having an upper surface 26 and a lower surface 28 flanking the bight 22.

Each of the concrete panels 12 includes opposite sides 30, 32, opposite ends 34, 36 and a top surface 37 which is generally aligned with the upper surface 26 of ball 24. The opposite ends 34, 36 of panel 12 may have vertically disposed and interrupted metal plates P secured thereto or embedded therein and held in place by embedded bolts or anchors. In the alternative, the opposite ends 34, 36 may have conventional angle irons partially embedded therein.

Each of the sides 30, 32 has the following configuration and structure with only the structure at side 30 being described for purposes of conciseness. In the preferred embodiment, side 30 has a substantially vertically disposed upper wall portion 33 (FIG. 3) having an upper end 35 and a lower end 38. Side 30 also has an intermediate wall portion 40, having an inner end 42 and an outer end 44. Side 30 further includes a lower wall portion 46, having an upper end 48 and a lower end 50, which extends downwardly and inwardly from the outer end 44 of intermediate wall portion 40. Wall portions 34, 40 and 46 define a projection 52 which extends outwardly from the side 30 of the panel 12. Side 30 also includes a recessed portion 54 formed in the lower end thereof.

Figure 3:
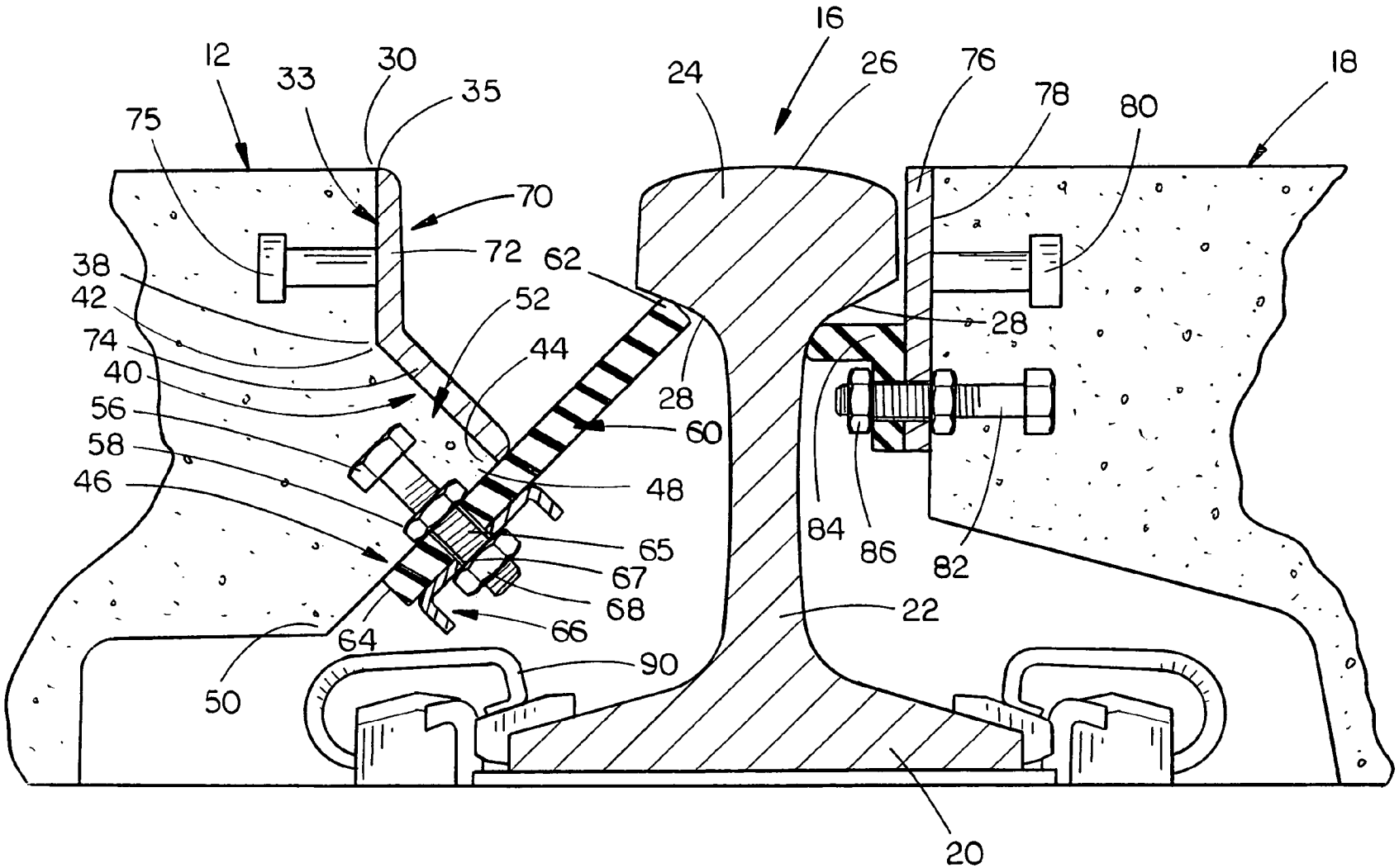
FIG. 3 is a sectional view illustrating the manner in which a field panel and a gauge panel are positioned relative to a rail.

A plurality of horizontally spaced-apart threaded fasteners or bolts 56 are embedded in projection 52 in a manner so that each of the fasteners 56 has a protruding portion extending outwardly and downwardly from lower wall portion 46. Preferably, a stabilizing nut 58 is threadably mounted on the fastener 56 and is also embedded in the projection 52 (FIG. 3).

The numeral 60 refers to an elongated, flat, resilient strip, comprised of a rubber or elastomeric material, having an upper end 62 and a lower end 64. The lower end of strip 60 has a plurality of openings 65 formed therein which are adapted to receive the protruding portions of the fasteners 56 therethrough so that the strip 60 may be secured thereto and which extends upwardly and outwardly in a manner which is parallel to the lower wall portion 46.

An elongated metal bar 66 preferably in the form of a channel member having plurality of spaced-apart openings 67 formed therein is positioned on the protruding portions of fasteners 56 outwardly of strip 60 and is secured to the fasteners 56 by nuts 68.

Figure 4:
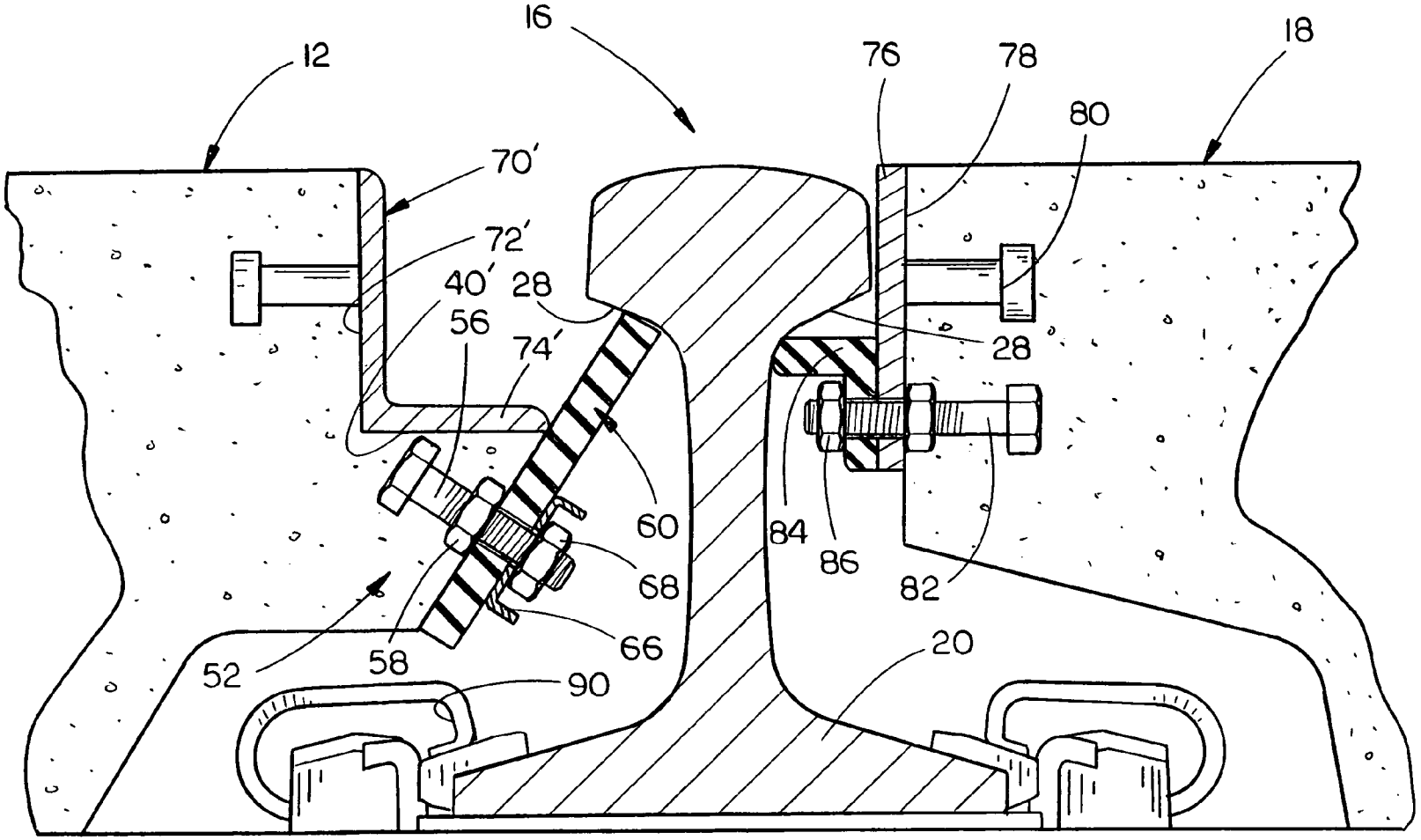
FIG. 4 is sectional view similar to FIG. 3 except that a modified form of the invention is disclosed.
Figure 5:
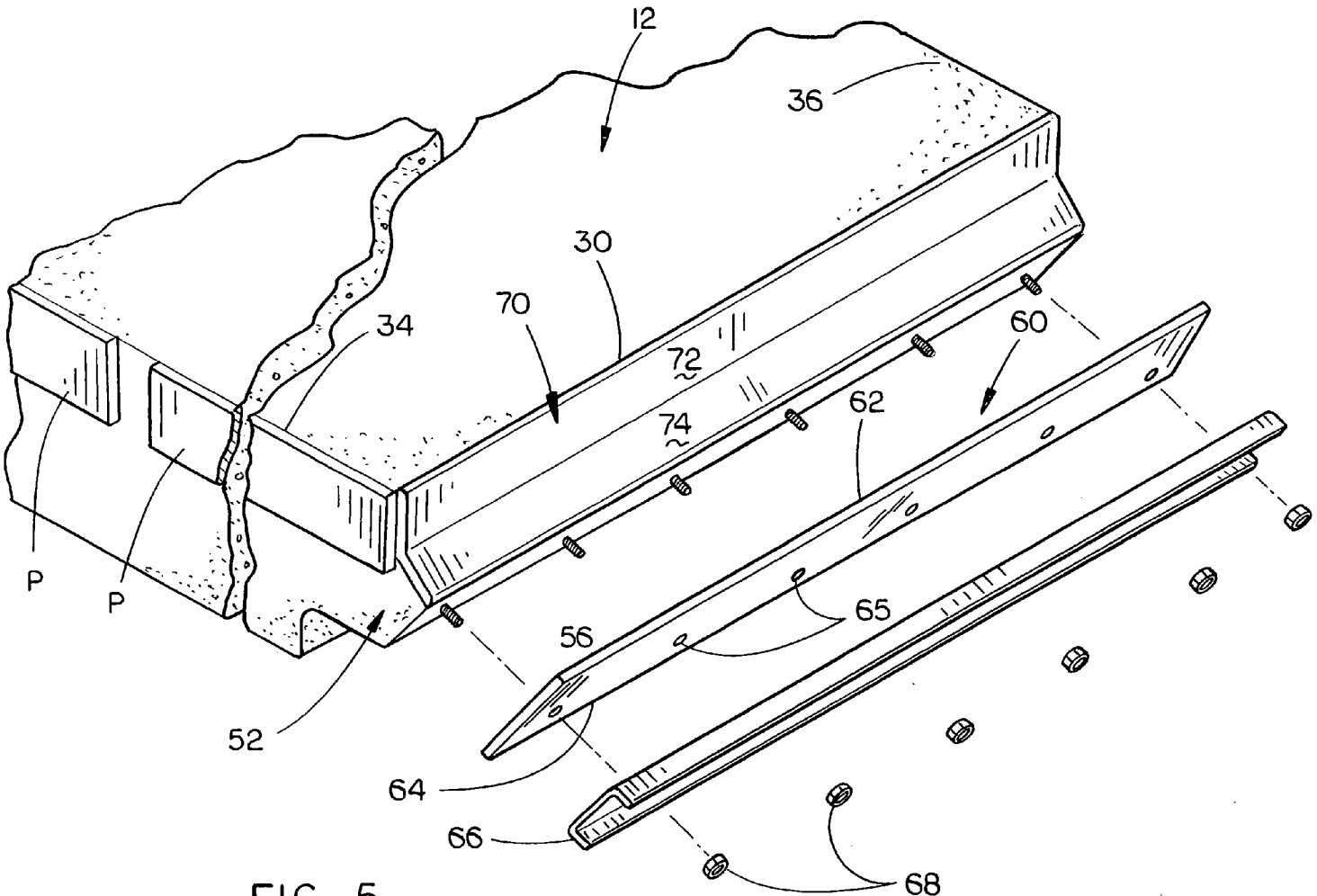
FIG. 5 is a partial exploded perspective view of the seal or strip which is positioned at one side of a gauge panel.

The numeral 70 refers to a metal angle member which has leg portions 72 and 74 positioned adjacent wall portions 34 and 40, respectively, and which is maintained thereon by embedded bolts or DBAs 75 or any other means. The angle between leg portions 72 and 74 may vary depending upon the particular rail, etc. FIG. 4 illustrates an embodiment wherein intermediate wall portion 40' extends horizontally outwardly from the lower end of upper wall portion 34'. In the embodiment of FIG. 4, the metal angle member 70' has a leg portion 74' which extends at a right angle from the lower end of leg portion 72'. The remaining structure in the embodiment of FIG. 4 is the same as the embodiment of FIGS. 2, 3 and 5.

The inner ends of each of field panels 18 (FIGS. 2-4) also have means attached thereto for resiliently engaging the outer sides of the associated rail. Each of the inner ends of the field panels have a metal plate 76 positioned on vertical face 78 of panel 18 which is secured thereto by elongated member embedded bolts or DBAs 80. A plurality of threaded fasteners 82 are partially embedded in the side of field panels 18 and have protruding portions which extend outwardly through openings in the lower end of plate 76. An elongated, resilient seal 84 in the form of a right angle is mounted on the protruding ends of the fasteners 82 and which are secured thereto by nuts 86.

The field panel 12 is fabricated by creating a form for the component parts which are to be included therewith. The plates P at the ends of the gauge panel 12 may be held in place in the form by electromagnets or other means which eliminates the need for welding angle irons together and placing the same in the form. The bolts 56 are positioned in the opposite sides of the gauge panel 12 in conventional fashion and if preferred, the strip 60, metal bars 66 and nuts 68 may be positioned thereon prior to concrete being placed into the form. In the alternative, the strip 60, metal bars 66 and nuts 68 may be secured to the panel after the panel has been poured, cured and removed from the form.

As stated hereinabove, the angle between the leg portions 74 and the leg portions 72 of the angle member 70 may be varied depending upon the particular type of rail securement means. The embodiment of FIG. 4 will provide more room for the rail securement means which is generally referred to by the reference numeral 90 as opposed to that as illustrated in FIG. 3.

With the seals 60 mounted on the fasteners 56, the gauge panel 12 may be moved into position between the rails 14 and 16 and the outer or upper ends of the seals 60 will be deflected as they pass the outer surfaces of the ball 24 and once the panel 12 is in place, the upper or outer ends of the seals 60 will be positioned closely adjacent the lower surface 28 of the ball 24 of the rails.

Figure 2:
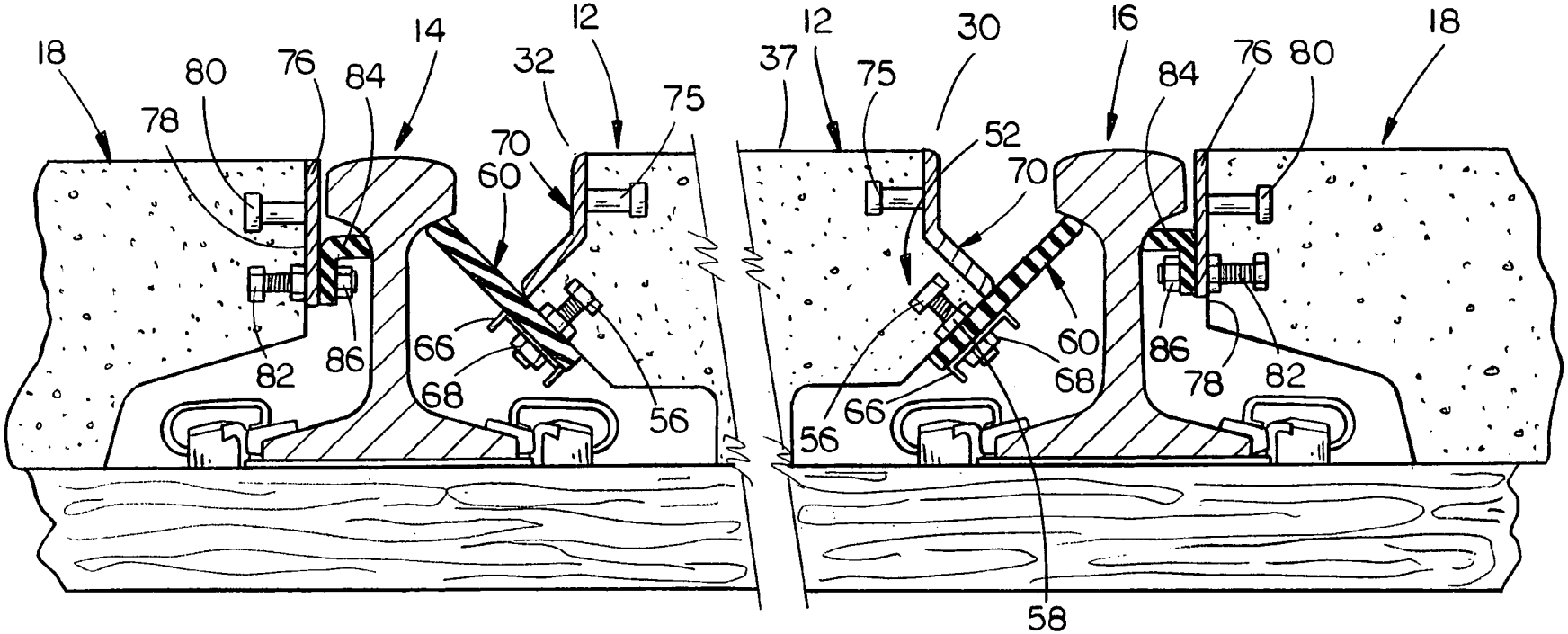
FIG. 2 is a partial sectional view of the installation.

The field panels will be placed in position in conventional fashion with the resilient angles 34 being positioned adjacent the outer surface of the bight of the associated rail, as illustrated in FIGS. 2 and 3.

The means by which the strips or seals 60 are secured to the panels 12 enables the strips to be easily replaced should they become worn or damaged. It is simply necessary to raise the panel 12 from between the rails, remove the nuts 68 and bars 66 and then remove the seals from the fasteners 56. A new strip or seal 60 may then be mounted on the fasteners 56 and secured thereto by replacing the metal bar 66 and the nuts 68. The panel 12 is then repositioned between the rails 14 and 16.

The resilient members or seals 84 on the field panels 18 may also be easily replaced by simply raising the inner ends of the field panels 18 and removing the nuts 86 from the fasteners 82 so that the member 84 may be removed therefrom. A new member 84 may then be positioned on the fasteners 82 and held in place by the nuts 86.

Thus it can be seen that a novel seal has been provided for use with gauge panels and field panels which enables the extrusions to be easily replaced should the same become damaged or worn. The panels are easily fabricated with less intensive welding labor and truly represent a significant advance in the art.

Thus it can be seen that the invention accomplishes at least all of its stated objectives.

I claim:

1. A railway crossing installation, comprising:

first and second spaced-apart elongated rails, each having in transverse section a bottom horizontal flange, a vertically extending bight and a top ball having an upper surface and a lower surface flanking said bight;

at least one relatively elongated concrete gauge panel with each gauge panel having a top surface generally aligned with said upper surface of said top ball, each gauge panel having elongated first and second sides disposed adjacent said pair of rails, respectively, and ends disposed in confronting relation to any adjacent panels;

each of said sides of said panel having a projection extending therefrom towards the associated rail and including a substantially vertically disposed upper wall portion having upper and lower ends, an intermediate wall portion, having inner and outer ends, extending outwardly away from said lower end of said upper wall portion, and a lower wall portion, having upper and lower ends, extending downwardly and inwardly from said outer end of said intermediate wall portion;

each of said sides of said gauge panel having a plurality of elongated threaded fasteners which are partially embedded in said projection in a manner so as to protrude outwardly and downwardly from said lower wall portion of said projection in a horizontally spaced-apart manner;

first and second resilient, elongated, flat strips having upper and lower ends and inner and outer faces which are selectively removably secured, adjacent their said lower ends, to the outwardly protruding portions of said fasteners at said first and second sides of said panels, respectively so as to extend upwardly and outwardly from said fasteners;

said lower ends of the inner face of said first and second flat strips being positioned adjacent said lower wall portions of the associated projection and said upper ends of said flat strips being positioned adjacent the associated rails;

and first and second metal angle members secured to said first and second sides of said panel, respectively, so as to be positioned adjacent said upper wall portion and said intermediate wall portion of the associated projection.

2. The installation of claim 1 wherein said intermediate wall portion of said projection extends downwardly and outwardly from said lower end of said upper wall portion thereof.

3. The installation of claim 1 wherein said intermediate wall portion of said projection extends substantially horizontally outwardly from said lower end of said upper wall portion thereof.

4. The installation of claim 1 wherein an elongated metal bar is positioned adjacent said outer face of each of said flat strips and has horizontally spaced-apart openings formed therein which receive the protruding portions of the associated threaded fasteners, and a nut secured to each of said threaded fasteners outwardly of said metal bar.

5. The installation of claim 4 wherein said metal bar comprises a channel member.

6. The installation of claim 1 wherein said projection also includes a generally horizontally extending wall portion which extends inwardly from said lower end of said lower wall portion thereof.

7. The installation of claim 1 wherein at least one relatively elongated field panel positioned outwardly of each of said rails with each of said field panels having a top surface generally aligned with said upper surface of said top ball, each field panel having an elongated inner side disposed adjacent the associated rail, and ends disposed in confronting relation to any adjacent panels; said inner side of each of said field panels having an elongated resilient seal member secured thereto which extends therefrom towards the associated rail.

8. The installation of claim 7 wherein each of said seal members is angular-shaped in cross-section.

9. The installation of claim 8 wherein said seal members are secured to said inner sides of said field panels by means of threaded fasteners partially embedded in said inner sides of said field panels and which extends outwardly therefrom through said seal members and held in place by nuts.

10. The installation of claim 9 wherein a flat, generally vertically disposed metal plate is secured to said inner side of the field panel, said threaded fasteners extending outwardly through said flat metal plate.

* * * * *